US008869733B2

(12) United States Patent
Parnell

(10) Patent No.: US 8,869,733 B2
(45) Date of Patent: Oct. 28, 2014

(54) OUTRIGGER PROTECTION SYSTEMS AND METHODS

(75) Inventor: Alex Parnell, Richton, MS (US)

(73) Assignee: The Southern Company, Atlanta, GA (US)

( * ) Notice: Subject to any disclaimer, the term of this patent is extended or adjusted under 35 U.S.C. 154(b) by 799 days.

(21) Appl. No.: 13/153,820

(22) Filed: Jun. 6, 2011

(65) Prior Publication Data

US 2011/0297073 A1 Dec. 8, 2011

Related U.S. Application Data

(60) Provisional application No. 61/351,346, filed on Jun. 4, 2010.

(51) Int. Cl.
*E02F 9/24* (2006.01)
*E02F 9/08* (2006.01)
*B66C 23/78* (2006.01)

(52) U.S. Cl.
CPC ..... *E02F 9/085* (2013.01); *B66C 23/78* (2013.01); *E02F 9/24* (2013.01)
USPC ..... 116/28 R; 116/28 A; 296/1.04

(58) Field of Classification Search
CPC ..... G01D 13/00; G08B 21/00; G08B 21/02; B60R 21/00; B60R 21/34; B60R 19/00; B60R 19/02; B60R 19/42
USPC ..... 116/28 R, 173, 28 A, 30, 32, 35 R, 116/50–53, 200, 205; 701/50; 296/1.04
See application file for complete search history.

(56) References Cited

U.S. PATENT DOCUMENTS

| | | | | | |
|---|---|---|---|---|---|
| 1,737,952 | A | * | 12/1929 | Storch et al. | 280/160 |
| 2,471,958 | A | * | 5/1949 | Humphreys | 16/18 CG |
| 2,605,119 | A | * | 7/1952 | Earnest | 280/849 |
| 3,019,913 | A | * | 2/1962 | Bowman | 212/303 |
| 3,677,417 | A | | 7/1972 | Keller, Jr. et al. | |
| 3,754,777 | A | | 8/1973 | Riggs et al. | |
| 3,976,306 | A | | 8/1976 | Nault | |
| 4,039,206 | A | | 8/1977 | Nault | |

(Continued)

OTHER PUBLICATIONS

Derwent Abstract, JP 10231541 A, Kideki Kato, "Safety Device for Heavy Machine", published Sep. 2, 1998.*

(Continued)

*Primary Examiner* — R. A. Smith
*Assistant Examiner* — Tania Courson
(74) *Attorney, Agent, or Firm* — Troutman Sanders, LLP; Ryan A. Schneider; Dustin B. Weeks

(57) ABSTRACT

An exemplary embodiment of the present invention provides an outrigger protection system for protecting an individual's foot from being crushed by a moving outrigger. The outrigger protection system includes a bottom plate and an outwardly extending protection element. The bottom plate is securable to the bottom of the conventional outrigger. The outwardly extending protection element can be integral with the either the bottom plate or the bottom of the outrigger and extends beyond the perimeter of the foot of the outrigger. If someone were standing in the way of the outrigger when the outrigger was being moved the protection element would strike the leg or shin. If, however, the outrigger protection system were to land on the foot, it would not crush the foot as it is non-weight-bearing.

17 Claims, 10 Drawing Sheets

(56) References Cited

U.S. PATENT DOCUMENTS

| | | | | |
|---|---|---|---|---|
| 4,460,889 | A * | 7/1984 | Elks | 340/436 |
| 4,473,239 | A * | 9/1984 | Smart | 280/763.1 |
| 4,546,840 | A * | 10/1985 | Yukishige et al. | 180/169 |
| 4,585,071 | A * | 4/1986 | Anderson et al. | 172/1 |
| 4,903,856 | A * | 2/1990 | Watts | 280/160 |
| 5,015,147 | A | 5/1991 | Taylor et al. | |
| 5,170,528 | A * | 12/1992 | Navar et al. | 16/18 CG |
| 5,371,920 | A * | 12/1994 | Rainville | 16/18 CG |
| 5,462,324 | A * | 10/1995 | Bowen et al. | 293/15 |
| 5,524,916 | A * | 6/1996 | Redens | 280/32.6 |
| 6,067,024 | A * | 5/2000 | Eckstine et al. | 340/679 |
| 6,231,081 | B1 | 5/2001 | Berke et al. | |
| 6,644,235 | B2 * | 11/2003 | Haynes | 116/28 R |
| 6,702,244 | B2 * | 3/2004 | Bock | 248/314 |
| 7,287,793 | B2 * | 10/2007 | Hamilton | 296/1.04 |
| 7,322,625 | B2 * | 1/2008 | Hamilton | 296/1.04 |
| 8,602,466 | B2 * | 12/2013 | Barron | 293/58 |
| 2003/0229424 | A1 * | 12/2003 | Miedema et al. | 701/1 |
| 2006/0267326 | A1 | 11/2006 | Richard | |
| 2011/0259258 | A1 * | 10/2011 | DePiero | 116/200 |
| 2014/0091189 | A1 * | 4/2014 | Koberg | 248/346.01 |
| 2014/0116975 | A1 * | 5/2014 | Benton et al. | 212/302 |

OTHER PUBLICATIONS

Derwent Abstract, JP 10114971 A, Tokioka et al., "Contact Preventative Device for Slewing Heavy Machine", published May 6, 1998.*

Derwent Abstract, JP 01299926 A, Hirotoshin Baba, "Rear Safety Confirmin Method for Rotating Vehicle", published Dec. 4, 1989.*

Derwent Abstract, JP 10338472A, Tokioka et al., "Contact Preventing Device of Construction Heavy Machine", published Dec. 22, 1998.*

* cited by examiner

OUTRIGGER PROTECTION SYSTEMS AND METHODS

CROSS-REFERENCE TO RELATED APPLICATIONS

This application claims the benefit of U.S. Provisional Application Ser. No. 61/351,346, filed 4 Jun. 2010, which is incorporated herein by reference in its entirety as if fully set forth below.

TECHNICAL FIELD OF THE INVENTION

The various embodiments of the present disclosure relate generally to safety systems and methods. More particularly, the various embodiments of the present invention are directed to outrigger protection systems and methods for protecting individuals standing in the vicinity of an outrigger from accidental crushing of that person's limbs or body.

BACKGROUND

Many vehicles, including bucket trucks, lift heavy loads to tall heights and thus employ an outrigger to stabilize the vehicle during a lift operation. The outrigger provides balance to prevent the vehicle from leaning too much to one side or the other. When the outrigger is not in use (e.g., when the vehicle is in motion), it is secured in a cavity of the vehicle. When the outrigger is being used, it can be hydraulically activated from a storage position, to a use position, extending outwardly and downwardly from the vehicle, engaging or resting on the ground. Outriggers commonly lift the entire vehicle, tires and all, off the ground.

Conventionally, outriggers comprise a beam, which is the leg of the outrigger, and a pad, which is the foot. The outrigger can be moved between its use and storage positions by hydraulics. In addition, sometimes floats are placed under the pad to dissipate the force and load over concrete or pavement. Floats are typically wood planks that are lined up to create a base that is larger than the pad itself.

Unfortunately, on more than one occasion, an individual standing on the construction site in the vicinity of the bucket truck has had his/her foot crushed by the outrigger, as the outrigger is being moved from its storage position to its use position. Thus, there is a desire for systems and methods of protecting individuals standing in proximity to outriggers when the outriggers are being placed in the use position.

SUMMARY

Briefly described, exemplary embodiments of the present invention relate to protection systems and methods for protecting an individual when an outrigger is being placed in the use position.

When a conventional outrigger is being place in the use position, it is possible for a person, who is standing in proximity to the outrigger and not paying attention, to have his or her foot, or other appendage, caught between the pad of the outrigger and the ground. Thus, some embodiments of the present invention provide outrigger protection systems configured to improve a conventional outrigger by warning an individual standing near the outrigger and moving them a safe distance to avoid being crushed. Instead of an audio alert, which due to their commonness, tend to be ignored at job sites, outrigger protection systems of the present invention provide the individual with a physical warning of the approaching outrigger. Thus, the individual is able to move his or her foot before an accidental crushing by the pad of the outrigger.

For example, in some embodiments of the present invention, the outrigger protection system is configured to the foot of the outrigger and strikes a person in the way of the moving outrigger to cause them to move out of the way, wherein the contact between the individual and the system is relatively minor. In some embodiments of the present invention, if the outrigger protection system were to land on the foot, it will not crush the foot, because it is non-weight-bearing; that is, it does not carry the weight of the bucket truck. An additional feature of some embodiments of the present invention is that the outrigger protection system can be retrofitted to a conventional outrigger, thus improving safety while lowering costs.

An exemplary embodiment of the present invention provides an outrigger protection system comprising a protection element positioned proximate the bottom pad of an outrigger. The protection element can extend outwardly from at least a portion of the outrigger. Upon deployment of the outrigger to the use position, the protection element would come into contact with an individual in proximity to the bottom pad (a potential strike zone) to warn the individual to move distal the zone, and thus the bottom pad. Otherwise the bottom pad could rest atop an appendage of the individual. The protection element can be a non-weight-bearing protection element. Thus, when the protection element comes into contact with the individual, it does not injure the individual but, instead, provides a physical warning of the approaching outrigger. In an exemplary embodiment of the present invention, the protection element comprises a plurality of outwardly extending members. In another exemplary embodiment of the present invention, each outwardly extending member is coupled to at least one lateral member.

In yet another exemplary embodiment of the present invention, the outrigger protection system includes a bottom plate. In this embodiment, the bottom plate can be securable to the bottom of the conventional outrigger, for example, in proximity to its foot or bottom pad. The outwardly extending protection element can be integral with the bottom plate and extend beyond the perimeter of the foot of the outrigger.

For example, the outwardly extending protection element can extend outwardly from the bottom plate and also can extend beyond the perimeter by at least eight to ten inches. If someone were standing in the strike zone of the outrigger when the outrigger was being moved, the protection element would contact the leg or shin. The outwardly extending protection element can be made of plastic straw elements, cables, and many other materials strong enough to alert/strike the person and cause them to move out of the way of the moving outrigger, yet of a design that the present safety system itself does not hurt the individual.

In another exemplary embodiment, the outrigger protection system includes (i) an outrigger extension, (ii) a protection element, and (iii) a bottom plate. The outrigger extension can engage, encircle, or be welded to the bottom section of a conventional outrigger, preferably to the foot or bottom pad. The protection element can be secured to the bottom of the outrigger extension. The protection element has a perimeter that exceeds the perimeter of both the bottom section of the conventional outrigger and the perimeter of the outrigger extension, for example, by at least eight to ten inches (the distance from the toe tip to leg). If someone were standing in the strike zone of the outrigger when the outrigger was being moved from the storage position to the use position, the protection element would contact the leg or shin causing the person to move out of the way. A bottom plate can be secured to the bottom of the outrigger to secure the protection element to the outrigger extension.

Yet another exemplary embodiment of the present invention provides a method of physically warning a person in proximity to an outrigger, e.g. the strike zone, to move out of the zone. The method comprises positioning an outrigger protection system proximate a bottom end of the outrigger. The outrigger protection system can comprise a protection element, such that the protection element provides a physical warning that the outrigger is being placed in the use position if a person is within a predetermined range of the outrigger system. In an exemplary embodiment, the protection element can extend outwardly from at least a portion of the outrigger. In another exemplary embodiment of the present invention, the predetermined range within which a person will be provided a physical warning is the distance that the protection element extends outwardly from the portion of the outrigger.

These and other aspects of the present invention are described in the Detailed Description of the Invention below and the accompanying figures. Other aspects and features of embodiments of the present invention will become apparent to those of ordinary skill in the art, upon reviewing the following description of specific, exemplary embodiments of the present invention in concert with the figures. While features of the present invention may be discussed relative to certain embodiments and figures, all embodiments of the present invention can include one or more of the features discussed herein. While one or more embodiments may be discussed as having certain advantageous features, one or more of such features may also be used with the various embodiments of the invention discussed herein. In similar fashion, while exemplary embodiments may be discussed below as system or method embodiments, it is to be understood that such exemplary embodiments can be implemented in various devices, systems, and methods of the present invention.

BRIEF DESCRIPTION OF THE DRAWINGS

The following Detailed Description of the Invention is better understood when read in conjunction with the appended drawings. For the purposes of illustration, there is shown in the drawings exemplary embodiments, but the subject matter is not limited to the specific elements and instrumentalities disclosed.

DETAILED DESCRIPTION OF THE INVENTION

Figure 1A:
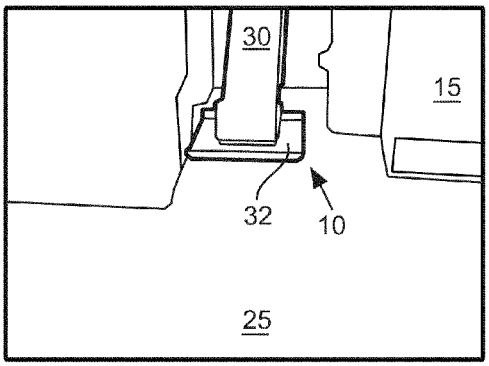
FIG. 1A illustrates a side view of a conventional outrigger in a storage position.

To facilitate an understanding of the principles and features of embodiments of the invention, they are explained hereinafter with reference to their implementation in an illustrative embodiment. Generally, embodiments of the present invention are described in the context of being protection systems and methods. More particularly, embodiments of the present invention are described in the context of being protection systems and methods for protecting people at a construction site. For example, embodiments of the present invention relate to a system that protects a person standing in vicinity of an outrigger from an accidental crushing of that person's limbs or body.

Embodiments of the present invention, however, are not limited to its use as a protection system for outriggers. Rather, embodiments of the invention can be used wherever a protection system is needed or desired. Thus, the outrigger protection system described hereinafter for use to protect a person's foot from being crushed by an outrigger can also find utility in providing protection from other objects or surfaces.

Additionally, the materials and components described hereinafter as making up the various elements of the protection system are intended to be illustrative and not restrictive. Many suitable materials and components that would perform the same or a similar function as the materials and components described herein are intended to be embraced within the scope of the invention. Such other materials and components not described herein can include, but are not limited to, for example, materials and/or components that are developed after the time of the development of embodiments of the present invention.

Referring now in detail to the figures, wherein like reference numerals represent like parts throughout the several views, FIGS. 1A-1E illustrate a conventional outrigger 10. Many vehicles 15—including bucket trucks, cranes, and the like—lift heavy loads to tall heights and thus employ an outrigger to stabilize the vehicle during a lift operation. The outrigger 10 provides balance to prevent the vehicle 15 from leaning too much to one side or the other. When the outrigger 10 is not in use (e.g., when the vehicle 15 is in motion), it is secured in a cavity of the vehicle 15.

Figure 1B:
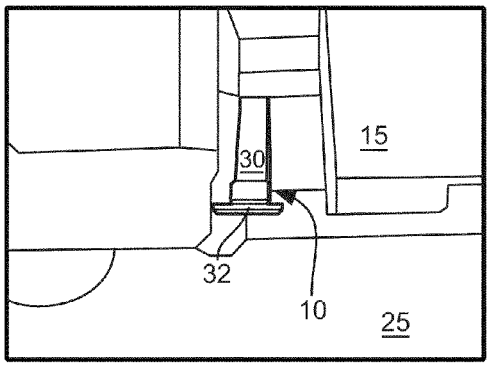
FIG. 1B illustrates a perspective view of the conventional outrigger of FIG. 1A in a storage position.
Figure 1C:
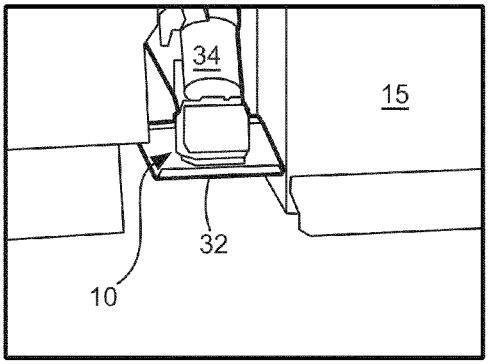
FIG. 1C illustrates another perspective view of the conventional outrigger of FIGS. 1A-1B in the storage position.
Figure 1D:
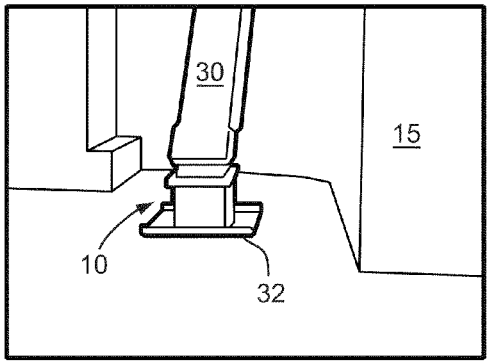
FIG. 1D illustrates a perspective view of the conventional outriggers of FIGS. 1A-1C moving from the storage position to a use position.
Figure 1E:
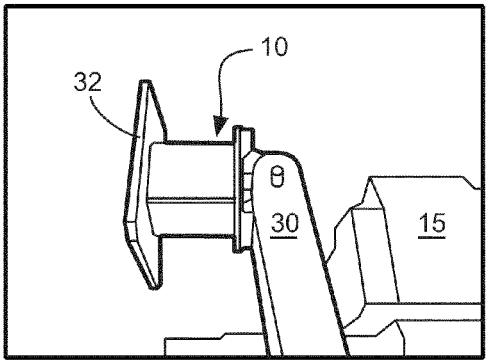
Fig. 1E Prior Art
FIG. 1E illustrates a perspective view of the conventional outrigger of FIGS. 1A-1D.

When the outrigger 10 is being used, it can be hydraulically activated from a storage position, as shown in FIGS. 1A-1C, to a use position, as shown generally in FIGS. 1D-1E, extending outwardly and downwardly from the vehicle. Ultimately, the outrigger 10 is in the use position when it rests upon or engages the ground 25. In the use position, outriggers 10 commonly lift the entire vehicle 15, tires and all, off the ground 25.

Conventionally, outriggers 10 comprise a beam 30, which is the leg of the outrigger, and a bottom pad 32, which is the foot. The outrigger 10 can be moved between its use and storage positions by a hydraulic system 34. In addition, sometimes floats are placed under the pad 32 to dissipate the force and load over the ground 25. Floats are usually wood planks that are lined up to create a base that is larger than the pad itself.

Figure 2:
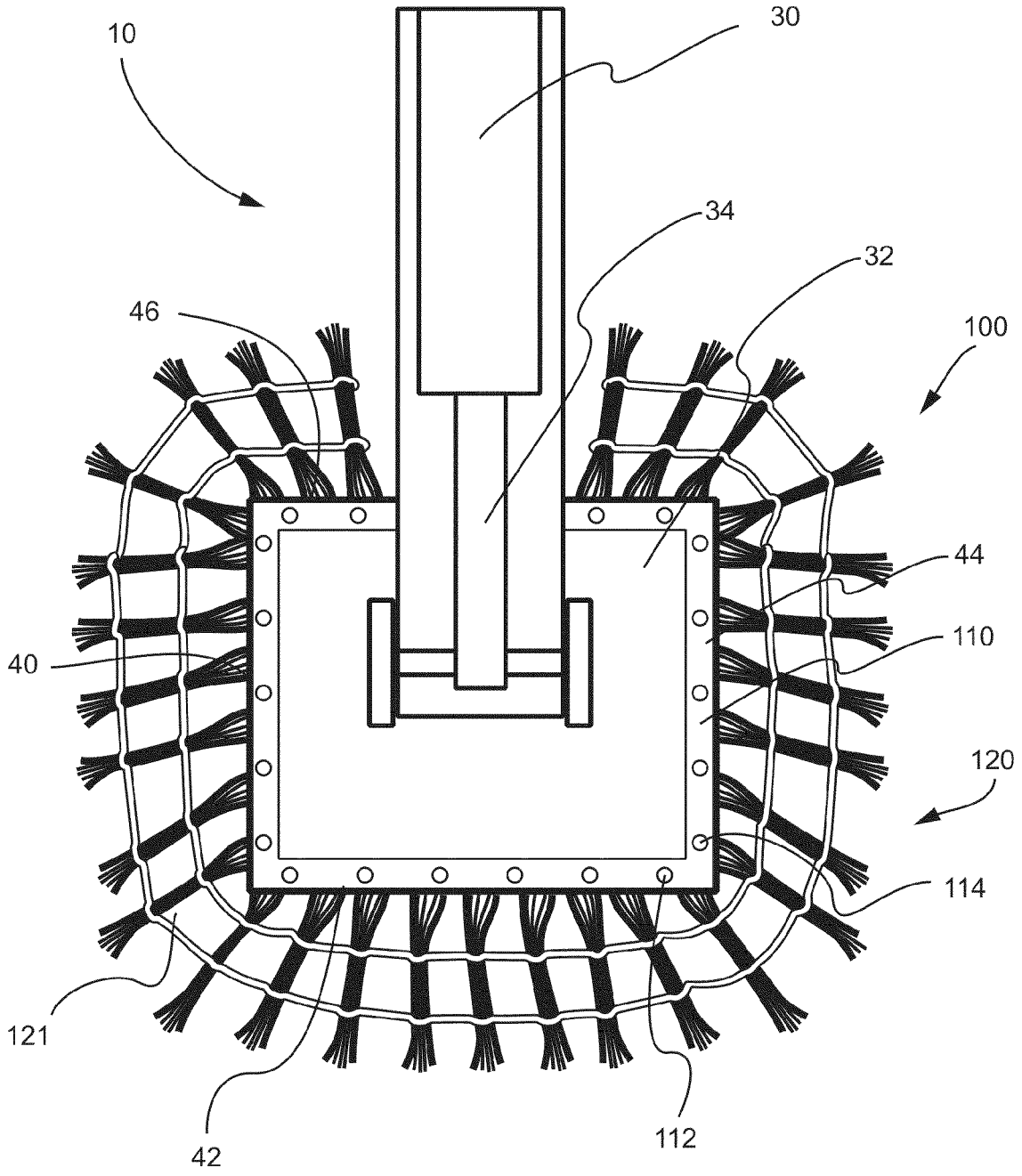
FIG. 2 illustrates a top view of an outrigger protection system, in accordance with an exemplary embodiment of the present invention.

FIG. 2 illustrates an outrigger protection system 100, in accordance with an exemplary embodiment of the present invention. The outrigger protection system 100 includes a bottom plate 110 and an outwardly extending protection element 120.

In this embodiment, the bottom plate 110 is securable to the bottom 32 of the conventional outrigger 10, for example to its foot. In some embodiments, the outwardly extending protection element 120 can be integral with the bottom plate 110. The outwardly extending protection element 120 extends beyond the perimeter of the foot 32 of the outrigger 10. The outwardly extending protection element 120 extends outwardly from the bottom plate 110 and also can extend beyond the perimeter of the bottom plate 110, for example in some embodiments by at least eight to ten inches. In some embodiments, the outwardly extending protection element 120 extends far enough beyond the perimeter of the bottom 32 to prevent one's foot from being crushed beneath the outrigger 10 and its foot 32.

If someone were standing in an outrigger's strike zone, i.e. a zone in which if the individual remained, the individual could be harmed by the outrigger 10 when it is deployed to the use position, the protection element 120 can strike the leg or shin, thus providing a physical warning or alert of the approaching outrigger 10. The outwardly extending protection element 120 can be made of plastic straw elements, cables, and the like, as long as it is composed of material sufficiently strong or rigid enough to alert/strike the person and cause them to move out of the way of the moving outrigger 10, yet the protection element does not harm or injure the individual. The bottom plate 110 is connectable to the bottom 32 of the outrigger 10. The bottom plate 110 includes a first surface and an opposing second surface. The first surface is in contact with the bottom 32 of the outrigger 10. The second surface, when the outrigger 10 is in the use position, can be in direct contact with the ground 25.

In some embodiments, the bottom plate 110 is substantially the same size as the bottom 32 of the outrigger 10. In other words, the bottom plate 110 has approximately the same perimeter as the bottom 32 of the outrigger 10. In some embodiments, it may be preferable for the shape of the bottom plate 110 to be the same shape as the bottom 32 of the outrigger 10. This may ease the task of attaching the bottom plate 110 to the outrigger. In many embodiments, the bottom plate 110 has a slightly greater perimeter than the bottom 32.

In an exemplary embodiment, the bottom plate 110 can have a plurality of apertures 112 along its perimeter. The apertures 112 can be sized to receive securing mechanisms 114 to secure the bottom plate 110 to the bottom 32 of the outrigger 10. In some embodiments, the apertures 112 can be positioned near the center point for coupling the bottom plate 110 to the bottom 32 of the outrigger 10. The bottom 32 of the outrigger 10 may have pre-existing apertures to receive the same securing mechanism 114 for securing the bottom plate 110 thereto. In some embodiments, however, apertures may need to be bored into the bottom 32 of the outrigger 10 for this connection.

Securing mechanisms 114 used to secure the bottom plate 110 to the bottom 32 can vary. The securing mechanisms 114 can be of a permanent or a releasable variety. Hence, the bottom plate 110 can be permanently or releasably connected to the outrigger 10. For example and not limitation, the securing mechanisms 114 can be many securing mechanisms known in the art, including, but not limited to, adhesives, nut and bolt connections, and the like.

The outwardly extending protection element 120 can be in communication with the bottom 32 of the outrigger 10. In one embodiment, the outwardly extending protection element 120 can be directly coupled to the bottom 32 of the outrigger 10. In another embodiment, the outwardly extending protection element 120 can be directly coupled to the bottom plate 110, which is securable to the bottom 32 of the outrigger 10.

The same securing mechanisms 114 used to secure the bottom plate 110 to the bottom 32 can also be used to connect the protection element 120 to the bottom plate 110 or the bottom 32. In some embodiments, the same type of securing mechanisms 114 used to secure the bottom plate 110 to the bottom 32 can also be used to connect the protection element 120 to the bottom plate 110 or the bottom 32. Additionally, in some embodiments of the present invention, the securing mechanisms 114 used to secure the bottom plate 110 to the bottom 32 can be a different type of securing mechanism than the securing mechanisms used to connect the protection element 120 to the bottom plate 110 or bottom 32.

The protection element 120 can surround one or more sides of the outrigger 10. In an exemplary embodiment of the present invention, the protection element 120 extends outwardly from at least a portion of the outrigger 10. The bottom 32 of many outriggers 10 have a rectangular, or in some cases square, shape. In an exemplary embodiment, the protection element 120 can be placed on or extend from the outside three edges 40, 42, and 44 of the bottom 32 of the outrigger 10. That is, the edge 46 that is closest to and facing the vehicle 15 may not be fitted with the protection element 120. Typically, that edge 46 is not able to strike a person near the outrigger, and thus having the protection element 120 is not necessary. In an alternative embodiment, the protection element 120 can be placed or extend from each and every edge 40, 42, 44, and 46 of the bottom 32 of the outrigger 10.

As illustrated in FIG. 2, the protection element 120 can be made of a plurality of polymers. For example, the protection element 120 can be made of a plurality of plastic straw materials. Preferably, a stiff thick straw material will be used, e.g., trimmer string. The straw material can be tied together in a broom-like shape for stability and to enhance stiffness.

Figure 3A:
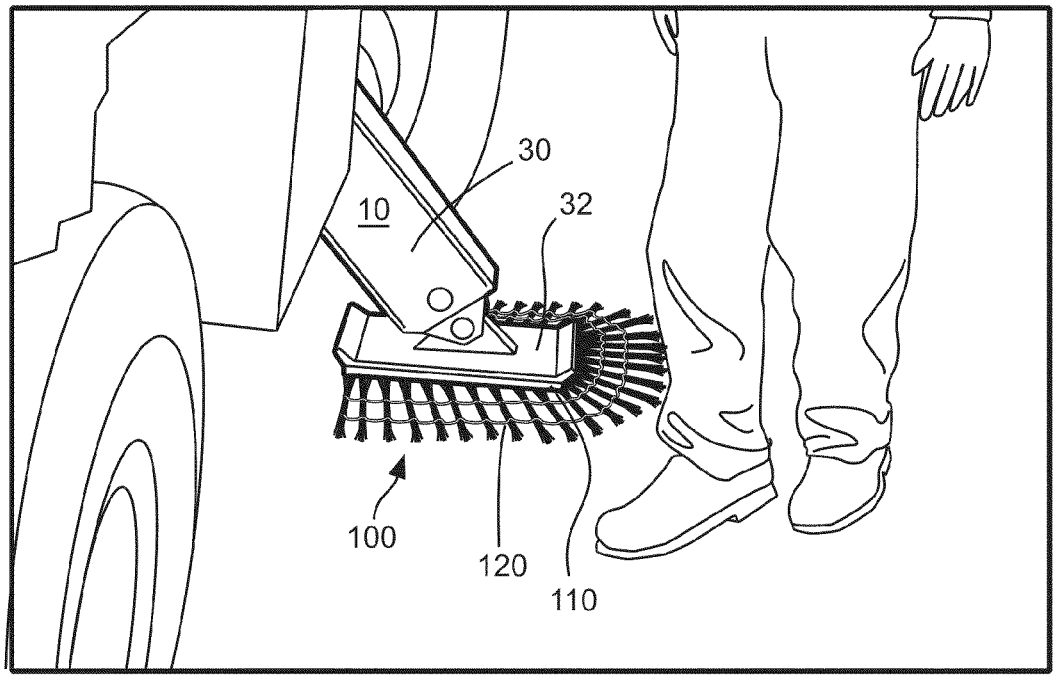
FIG. 3A illustrates a perspective view of the outrigger protection system attached to the conventional outrigger, which is moving from the storage position to the use position, in accordance with an exemplary embodiment of the present invention.
Figure 3B:
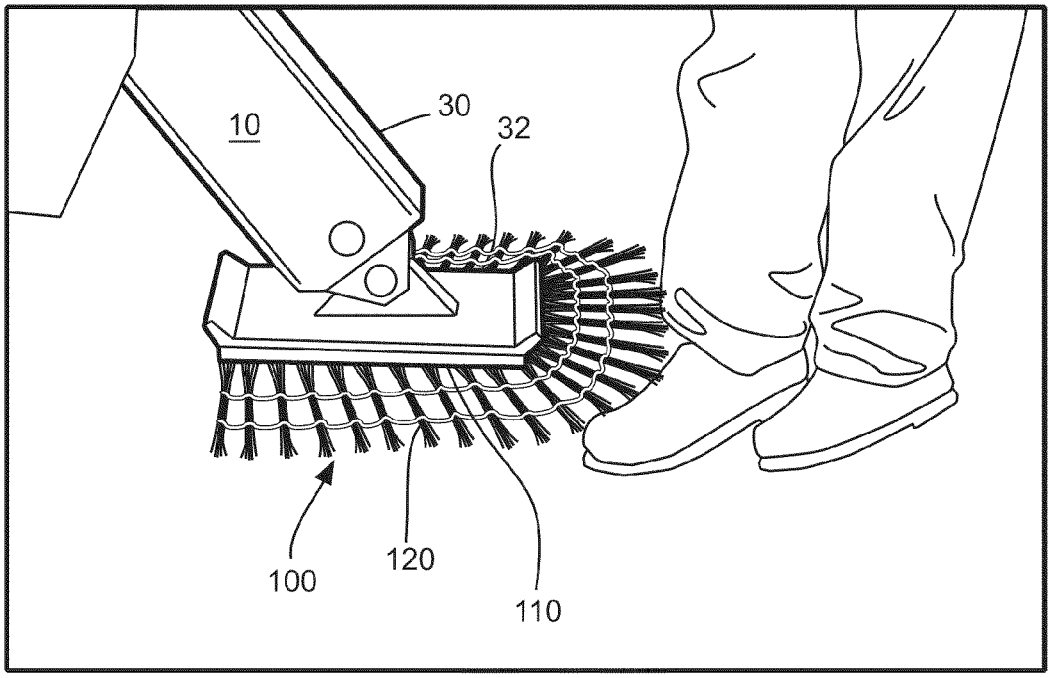
FIG. 3B illustrates another perspective view of the outrigger protection system of FIG. 3A attached to the conventional outrigger, which is moving from the storage position to the use position, in accordance with an exemplary embodiment of the present invention.

FIGS. 3A and 3B illustrate views of how a person standing near the vehicle when the outrigger 10 is being extended from the storage position to the use position can strike the person. The protection element 120, as illustrated in FIGS. 3A and 3B, extends outwardly from the outrigger 10 beyond the perimeter of the bottom 32 of the outrigger 10. When the outrigger 10 is moving from the storage position, the protection element 120 can strike a person standing in the area in which the outrigger is moving. Rather than implementing audio alerts, embodiments of the present invention incorporate physical alerts to cause the person to move out of the way from the moving outrigger 10 and thus protect the person's limbs, particularly their feet, from being crushed by the outrigger 10.

Figure 4A:
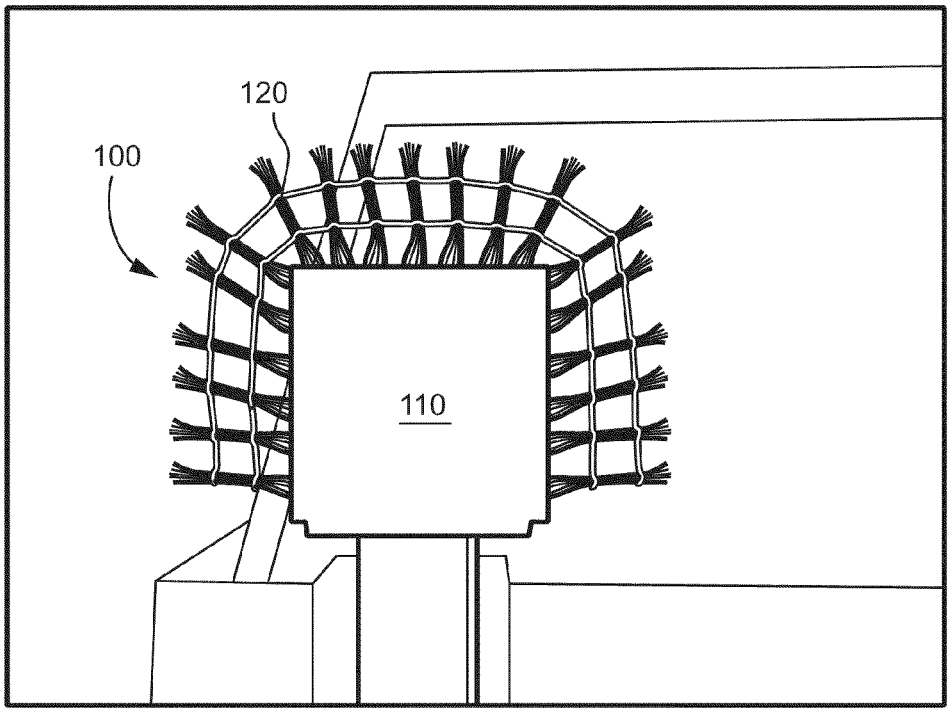
FIG. 4A illustrates a bottom view of the outrigger protection system attached to the conventional outrigger, in accordance with an exemplary embodiment of the present invention.
Figure 4B:
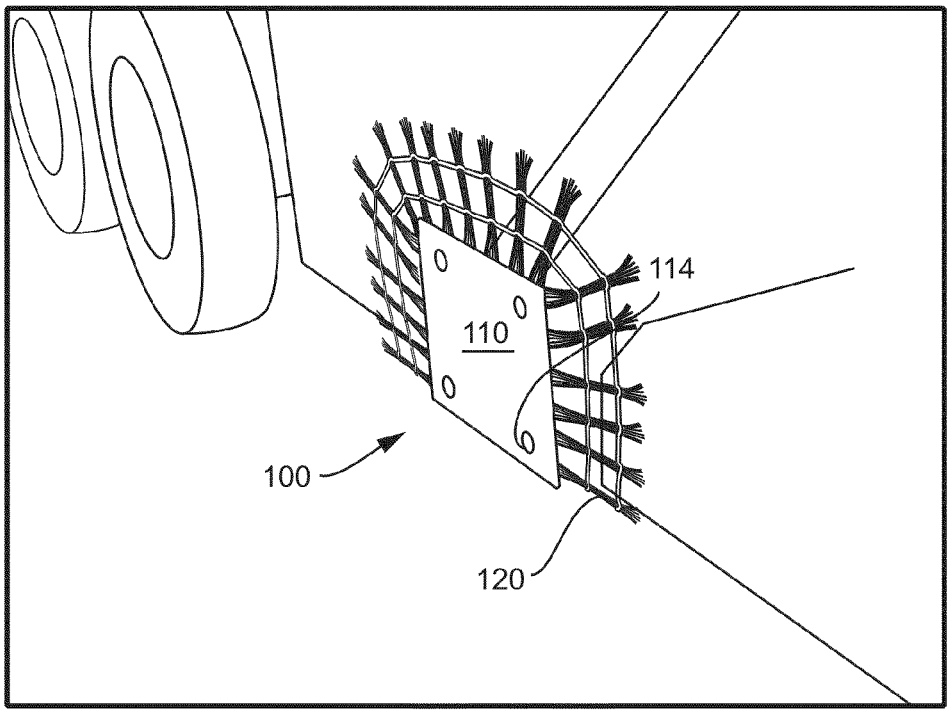
FIG. 4B illustrates a bottom, perspective view of the outrigger protection system attached to the conventional outrigger, in accordance with an exemplary embodiment of the present invention.

FIG. 4A illustrates a bottom view of the outrigger protection system 100 attached to the conventional outrigger 10, while FIG. 4B illustrates a bottom, perspective view of the outrigger protection system 100 attached to the conventional outrigger 10.

Figure 5:
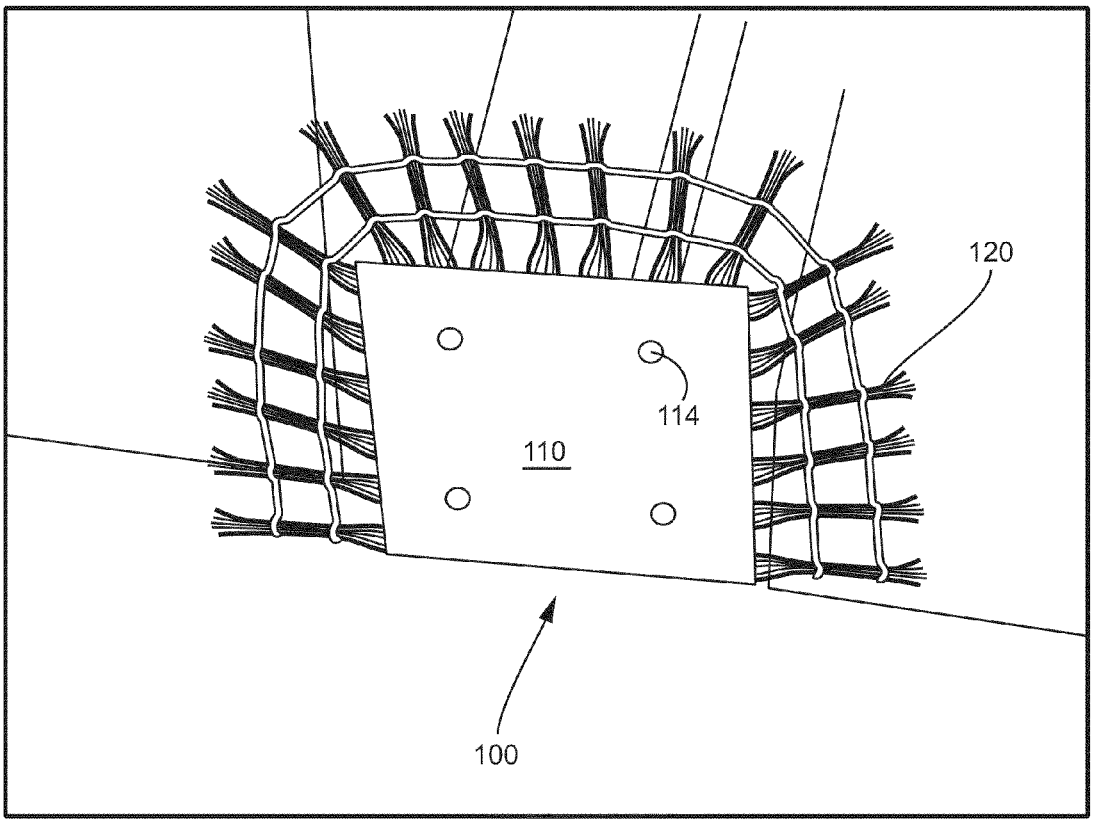
FIG. 5 illustrates a bottom view of the outrigger protection system being attached to the conventional outrigger, in accordance with an exemplary embodiment of the present invention.

FIG. 5 illustrates a bottom view of the outrigger protection system 100 being attached to the conventional outrigger 10. Here, the outrigger protection system 100 is secured to the bottom 32 of the outrigger 10 at a few interior locations. The outrigger protection system 100 can be secured to either the bottom 32 or to the bottom plate 110 by a plurality of securing mechanisms 114.

Figure 6:
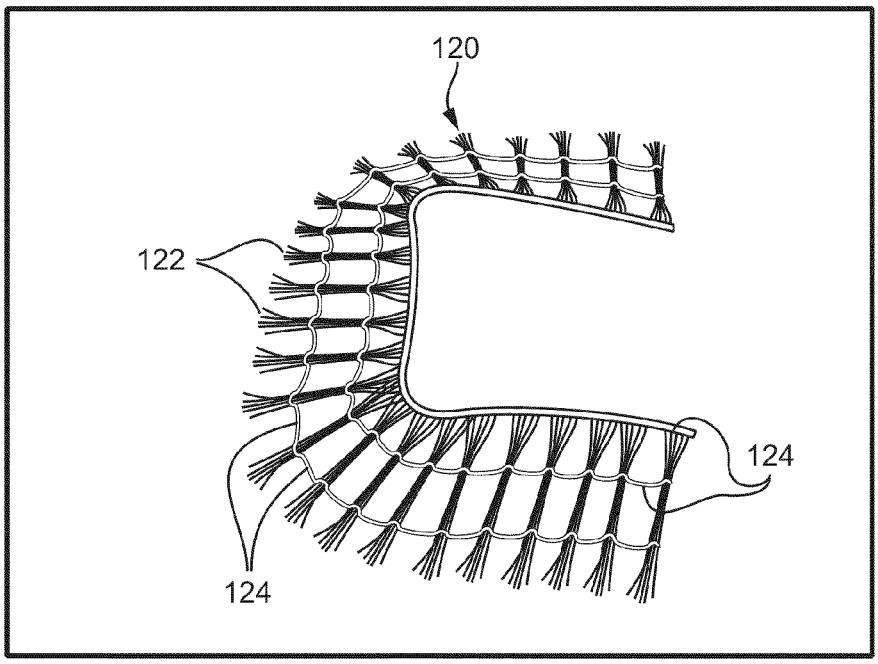
FIG. 6 illustrates a perspective view of an outwardly extending protection element of the outrigger protection system, in accordance with an exemplary embodiment of the present invention.
Figure 7:
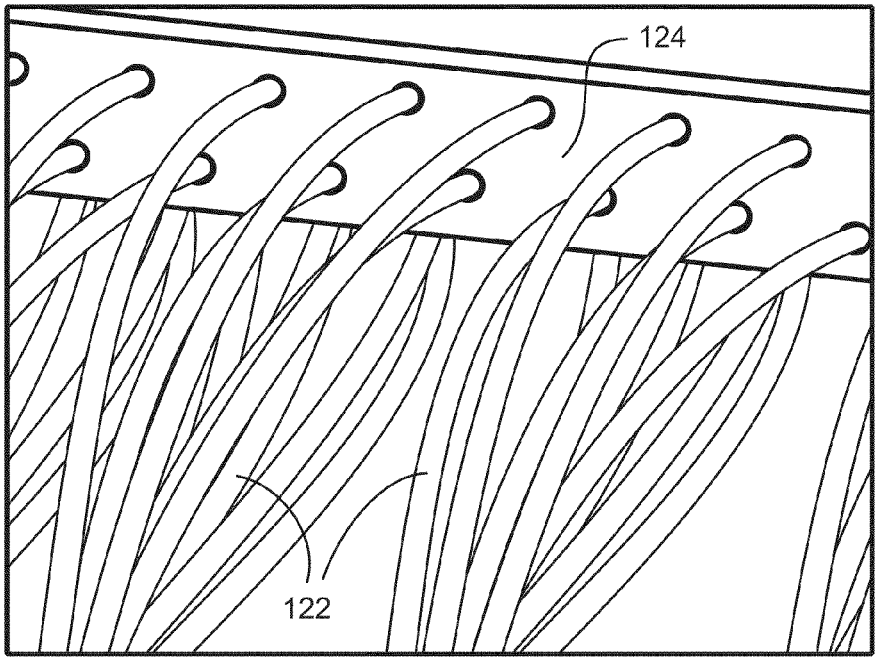
FIG. 7 illustrates a close-up top view of a portion of the outwardly extending protection element of the outrigger protection system, in accordance with an exemplary embodiment of the present invention.

FIG. 6 illustrates a perspective view of an outwardly extending protection element 120 of the outrigger protection system 100, and FIG. 7 illustrates a close-up top view of a portion of the outwardly extending protection element 120 of the outrigger protection system 100. The protection element 120 of the outrigger protection system 100 can have a plurality of outwardly extending members 122. Each of the extending members 122 can be rather stiff to contact and alert a person standing near the outrigger 10 when being moved to the use position. The extending members 122 can be coupled to one or more lateral members 124, which can stabilize and maintain the integrity of the protection element 120.

Figure 8A:
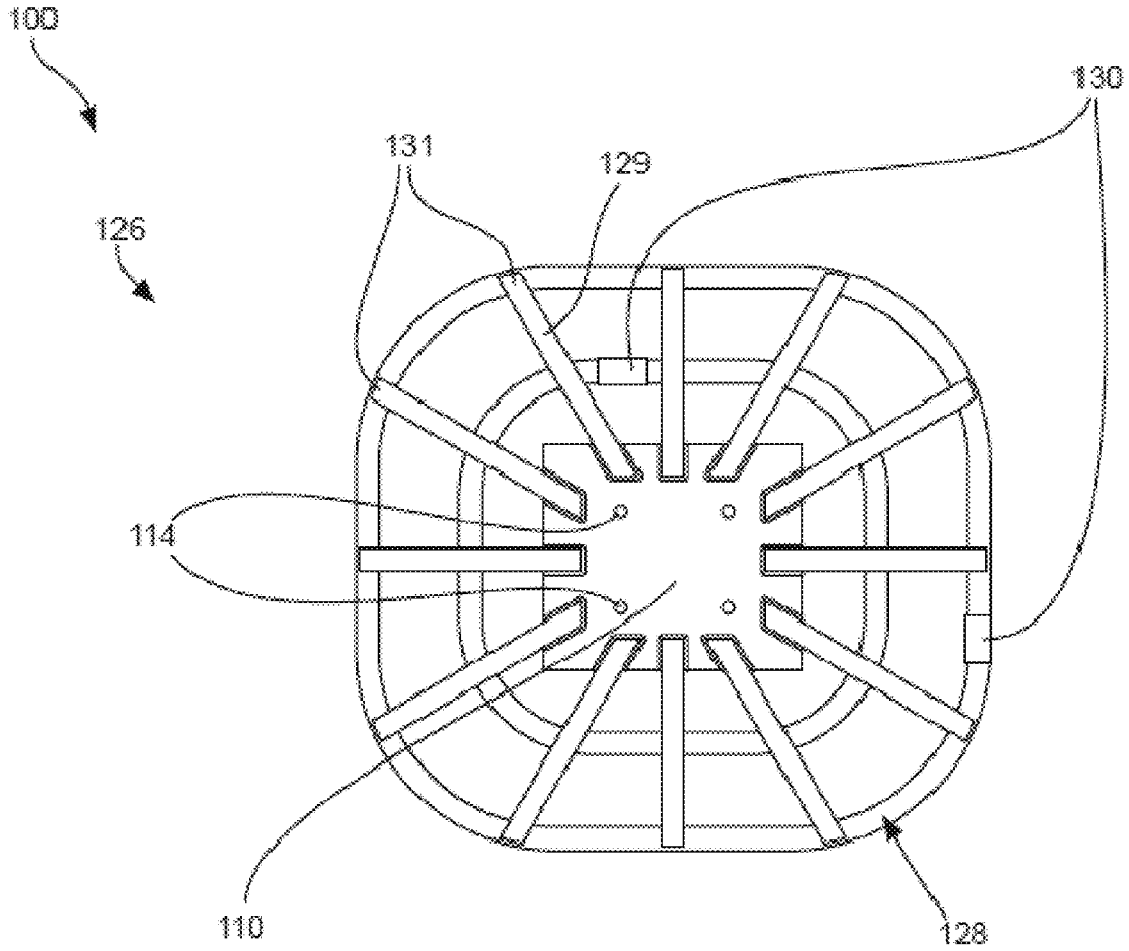
FIG. 8A illustrates a top view of an outrigger protection system, in accordance with an exemplary embodiment of the present invention.

FIG. 8A illustrates another embodiment of the outrigger protection system 100. The protection element 120 can be implemented by a cable system 126. In an exemplary embodiment, the cable system 126 includes one or more cables 128, which as shown in FIG. 8A and in some embodiments may number at least two, encircling the bottom plate 110, which also encircles the bottom 32 of the outrigger 10. The encircling pair of cables 128 can be held together by a plurality of outwardly extending support cables 129. The cables 128 can be elongated, flexible cables. At the terminating ends of the elongate, flexible end can be coupling connectors 130 to couple the flexible cable into the encircling shape. The outwardly extending support cables 129 can be secured to the bottom plate 110 and extend therefrom to connect to each of the cables 128. In some embodiments, the outwardly extending support cables 129 can be welded 131 to the bottom plate 110 and the cables 128. In some embodiments of the present invention, the protection element 120 embodiment can be coupled directly to the bottom 32 of the outrigger 10, and thus does not require the bottom plate 110.

Figure 8B:
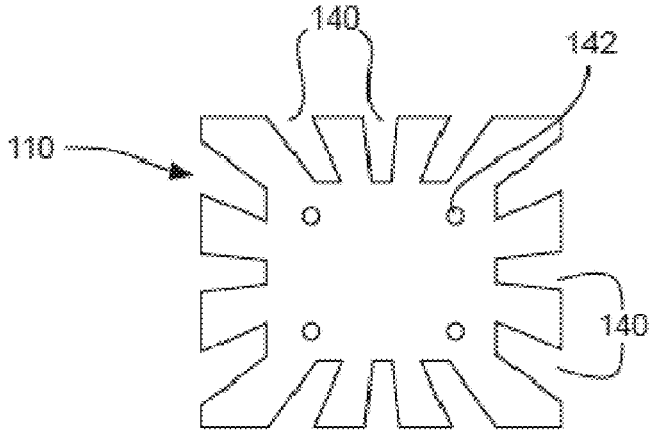
FIG. 8B illustrates a top view of a bottom plate of the outrigger protection system, in accordance with an exemplary embodiment of the present invention.

In some embodiments of the present invention, the bottom plate 110 can be the same shape, or a similar shape, to the bottom 32 of the outrigger 10. In some embodiments, the bottom plate 110 can have a shape as illustrated in FIG. 8B. The cutouts 140 along the edge of the bottom plate 110 can be connection points between the outwardly extending support cables 129 and the bottom 32. In addition, the bottom plate 110 can define a plurality of apertures 142, which can receive the securing mechanisms 114 to secure the bottom plate 110 to the bottom 32. As mentioned above, the securing mechanisms 114 can vary, but can be in many embodiments a bolt/nut combination; the apertures 142 can be sized to receive and maintain the diameter of the bolt. Preferably, the apertures 114 can lineup with apertures, either pre-existing or newly bored, in the bottom 32.

Figure 9A:
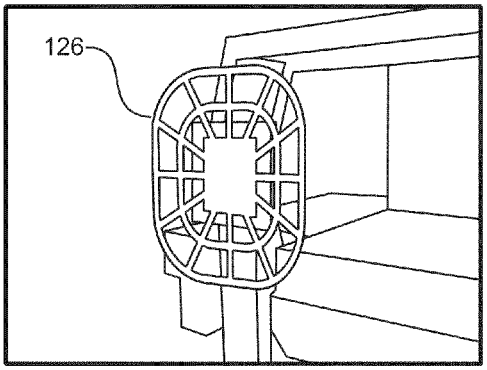
FIG. 9A illustrates a bottom, perspective view of the outrigger protection system of FIG. 8 attached to the conventional outrigger, in accordance with an exemplary embodiment of the present invention.
Figure 9B:
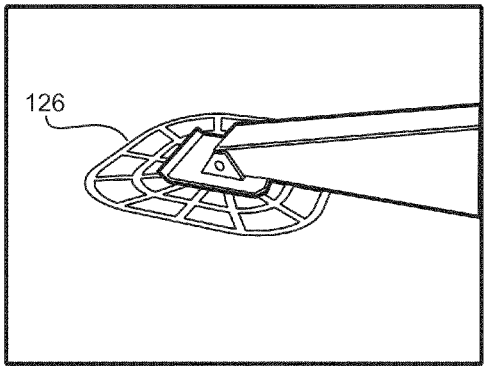
FIG. 9B illustrates a perspective view of the outrigger protection system of FIGS. 8-9A attached to the conventional outrigger, which is in the use position, in accordance with an exemplary embodiment of the present invention.
Figure 9C:
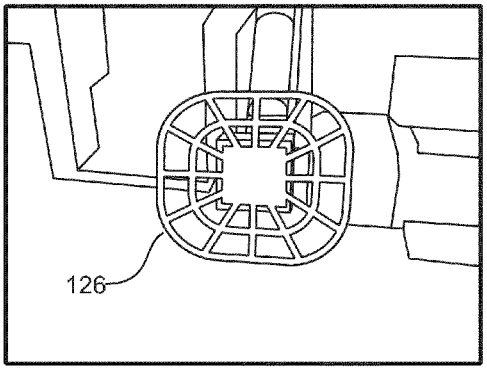
FIG. 9C illustrates a bottom view of the outrigger protection system of FIGS. 8-9B attached to the conventional outrigger, in accordance with an exemplary embodiment of the present invention.
Figure 9D:
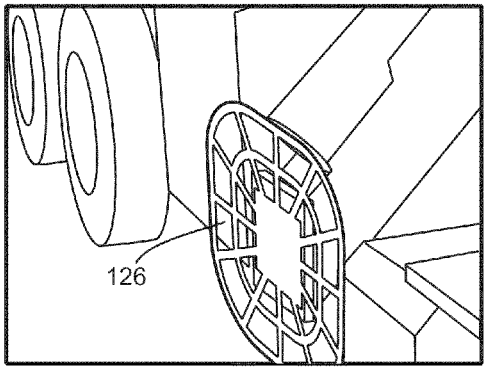
FIG. 9D illustrates a side, perspective view of the outrigger protection system of FIGS. 8-9C attached to the conventional outrigger, in accordance with an exemplary embodiment of the present invention.
Figure 9E:
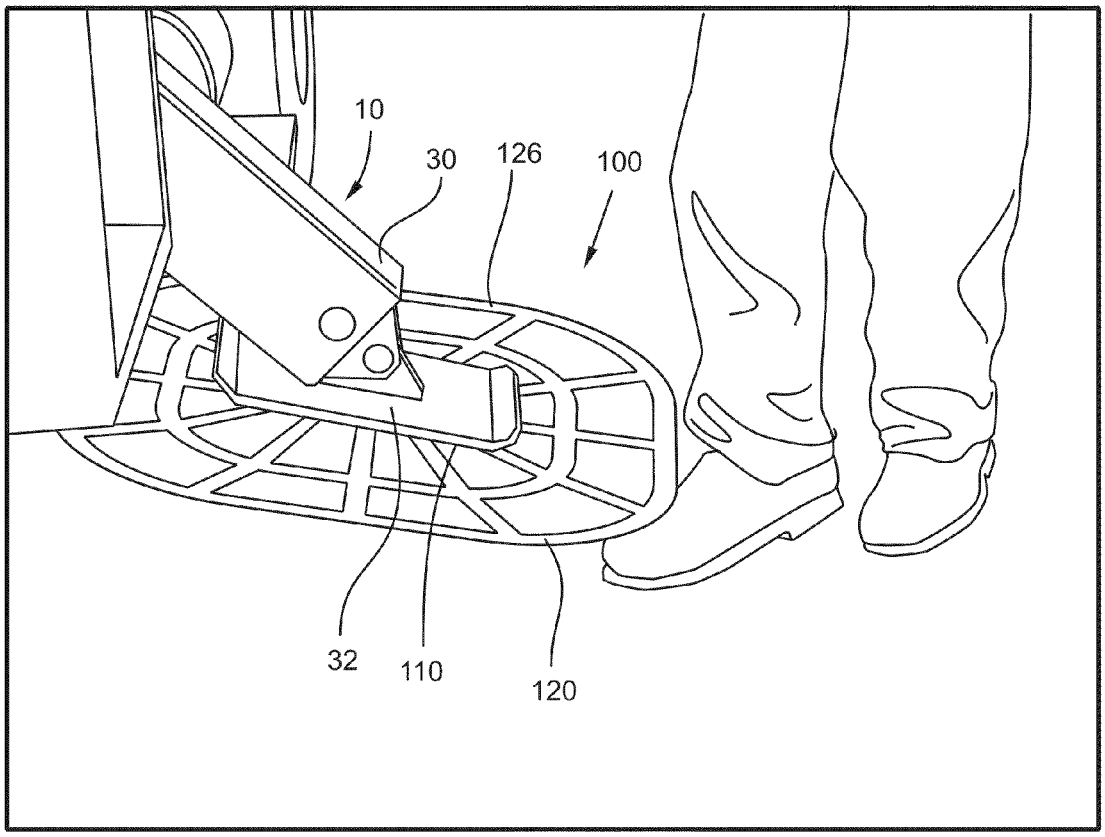
FIG. 9E illustrates a perspective view of the outrigger protection system of FIGS. 8-9D attached to the conventional outrigger and protecting the foot of a person in proximity to the conventional outrigger, in accordance with an exemplary embodiment of the present invention.

FIGS. 9A-9E illustrate various views the cable system 126 connected to the bottom plate 110, which is ultimately connected to the bottom 32 of the outrigger 10. FIG. 9E illustrates a view of how a person standing near the vehicle when the outrigger 10 is being extended from the storage position to the use position can strike the person. The protection element 120, as described herein, extends beyond the perimeter of the bottom 32 of the outrigger 10. When the outrigger 10 is moving from the storage position to the use position, the protection element 120 can strike a person standing within a predetermined range of the outrigger 10. In some embodiments of the present invention, the predetermined range is the distance that the protection element 120 extends outwardly from the outrigger 10. Rather than implementing audio alerts, embodiments of the present invention incorporate physical alerts to cause the person to move out of the way from the moving outrigger 10 and thus protect the person's limbs, particularly their feet, from being crushed by the outrigger 10. Here, the cable system 126 can strike the person to cause them to move. Even if the outrigger protection system 100 were to land on the foot, as it is not designed to carry weight (but only warn), it would not crush the foot as it does not bear the wear/force of the outrigger 10. Thus, in some embodiments of the present invention, the protection element 120 is a non-weight-bearing protection element. As used herein, a non-weight-bearing protection element is a protection element 120 that is configured to the outrigger 10 such that it does not support the weight of the vehicle 15 when the outrigger 10 is in the use position. For example, the protection element 120 can be connected to the outrigger 10 such that it is does not come into contact with the ground 25 when the outrigger 10 is in the use position.

Figure 10A:
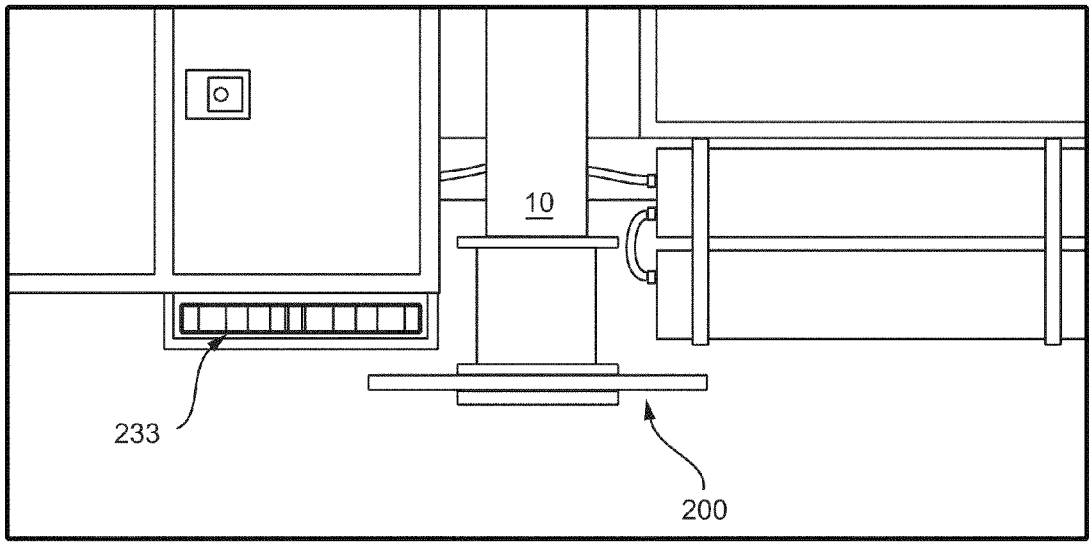
FIG. 10A illustrates a side view of an outrigger protection system, in accordance with an exemplary embodiment of the present invention.
Figure 10B:
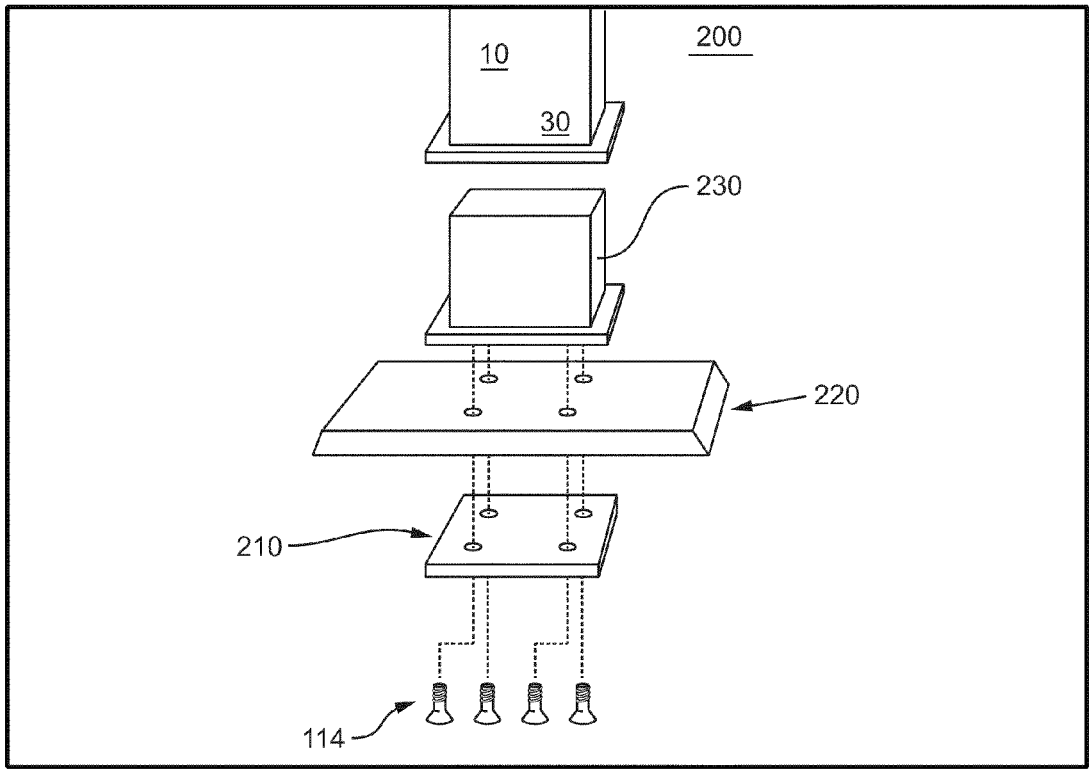
FIG. 10B illustrates an exploded view of the outrigger protection system of FIG. 10A, in accordance with an exemplary embodiment of the present invention.

FIGS. 10A-10B illustrate another exemplary embodiment of the outrigger protection system 100. In an exemplary embodiment, an outrigger protection system 200 includes an outrigger extension 230, a protection element 220, and a bottom plate 210. The outrigger extension 230 can engage, encircle, or be welded to the bottom 32 of a conventional outrigger 10, preferably to the foot. The protection element 220 can be secured to the bottom of the outrigger extension 230. The protection element 220 has a perimeter that exceeds the perimeter of both the conventional outrigger 10 and the perimeter of the outrigger extension 230, for example, by at least eight to ten inches (the distance from the toe tip to leg). If someone were standing in the way of the outrigger 10 when the outrigger 10 was moving from the storage position to the use position the protection element 220 would strike the leg or shin causing the person to move out of the way. A bottom plate 210 can be coupled to the protection element 220 to secure the protection element 220 to the outrigger extension 230. In some embodiments of the present invention, the outrigger protection system is releasably connected to the outrigger such that when the outrigger is not being used, the outrigger protection system can be stored in an outrigger protection storage location 233.

In addition to outrigger protection systems 100, some embodiments of the present invention relate to methods of physically warning a person in proximity to an outrigger. In an exemplary embodiment of the present invention, a method comprises positioning an outrigger protection system 100 proximate a bottom end of the outrigger 10. The outrigger protection system 100 can comprise a protection element 120, such that the protection element 120 provides a physical warning that the outrigger 10 is being placed in the use position if a person is within a predetermined range of the outrigger 10. In an exemplary embodiment, the protection element 120 can extend outwardly from at least a portion of the outrigger 10. In another exemplary embodiment of the present invention, the predetermined range within which a person will be provided a physical warning is the distance that the protection element extends outwardly from the portion of the outrigger 10.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the International Receiving Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. In an outrigger for stabilizing a vehicle or piece of equipment, the outrigger comprising an extension with a bottom pad, wherein the bottom pad is positioned at an end of the extension such that when the outrigger is in use, the bottom pad supports weight applied to the outrigger, an outrigger protection system comprising:

a protection element connected to the bottom pad and extending outwardly from at least a portion of the outrigger, wherein the protection element is non-weight-bearing wherein upon deployment of the outrigger, the protection element will contact an individual in a strike zone, the strike zone being a zone in which if the individual remained, the individual could be contacted by a portion of the outrigger when the outrigger is deployed to a use position, wherein the protection element warns the individual to move distal at least the bottom pad and out of the strike zone.

2. The outrigger protection system of claim 1, further comprising a bottom plate integral with the protection element, the bottom plate comprising a plurality of apertures sized to receive securing mechanisms to releasably connect the bottom plate to the bottom pad.

3. The outrigger protection system of claim 1, wherein the protection element comprises a plurality of outwardly extending members.

4. The outrigger protection system of claim 3, wherein each outwardly extending member in the plurality of outwardly extending members is coupled to at least one lateral member.

5. The outrigger protection system of claim 3, wherein the plurality of outwardly extending members are made of plastic.

6. The outrigger protection system of claim 1, wherein the protection element comprises a cable system.

7. An outrigger protection system for providing a physical warning when an outrigger is being placed in a use position, the system comprising:

a bottom plate connected to a bottom end of the outrigger and a non-weight-bearing protection element positioned proximate the bottom plate, wherein the protection element extends outwardly from at least a portion of the outrigger, wherein the protection element is configured to provide a physical warning to a person within a predetermined range of the outrigger when the outrigger is being placed in a use position.

8. The outrigger protection system of claim 7, wherein the bottom plate comprises a plurality of apertures, the apertures sized to receive securing mechanisms to releasably connect the bottom plate to the bottom of the outrigger.

9. The outrigger protection system of claim 7, wherein the protection element extends outwardly from less than the entire perimeter of the outrigger.

10. The outrigger protection system of claim 7, wherein the protection element comprises a plurality of outwardly extending members.

11. The outrigger protection system of claim 10, wherein each outwardly extending member in the plurality of outwardly extending members is coupled to at least one lateral member.

12. The outrigger protection system of claim 7, wherein the protection element comprises a cable system.

13. The outrigger protection system of claim 7, wherein the protection element is integral with the bottom plate.

14. A method of physically warning a person in proximity to an outrigger system comprising:

attaching an outrigger protection system to a bottom end of the outrigger, the outrigger protection system comprising a protection element, such that the protection element provides a physical warning that the outrigger is being placed in the use position if the person is within a predetermined range of the outrigger system.

15. The method of claim 14, wherein the protection element extends outwardly from at least a portion of the outrigger.

16. The method of claim 15, wherein the predetermined range is a distance that the protection element extends outwardly from the at least a portion of the outrigger.

17. The method of claim 14, wherein the protection element comprises a plurality of outwardly extending members.

* * * * *